US005716765A

United States Patent [19]

McGuckin et al.

[11] Patent Number: 5,716,765

[45] Date of Patent: Feb. 10, 1998

[54] PROCESSING MAGNETIC-BACKED SILVER HALIDE FILMS WITH A FINAL PROCESSING SOLUTION

[75] Inventors: Hugh Gerald McGuckin, Rochester; John Stuart Badger, Webster; Brad Mitchell Boersen, Rochester, all of N.Y.

[73] Assignee: Eastman Kodak Company, Rochester, N.Y.

[21] Appl. No.: 639,858

[22] Filed: Apr. 19, 1996

[51] Int. Cl.[6] ..... G03C 7/407

[52] U.S. Cl. ..... 430/372; 430/428; 430/429; 430/463; 430/533

[58] Field of Search ..... 430/372, 428, 430/429, 463, 533

[56] References Cited

U.S. PATENT DOCUMENTS

| | | | |
|---|---|---|---|
| 4,778,748 | 10/1988 | Kuse et al. | 430/463 |
| 4,786,583 | 11/1988 | Schwartz | 430/372 |
| 4,859,574 | 8/1989 | Gormel | 430/372 |
| 5,110,716 | 5/1992 | Kuse et al. | 430/463 |
| 5,229,259 | 7/1993 | Yokota | 430/531 |
| 5,254,446 | 10/1993 | Ikenoue et al. | 430/503 |
| 5,256,524 | 10/1993 | Yoshimoto et al. | 430/428 |
| 5,336,589 | 8/1994 | Mukunoki et al. | 430/501 |
| 5,360,700 | 11/1994 | Kawamura et al. | 430/428 |
| 5,376,484 | 12/1994 | Iwagaki | 430/553 |
| 5,395,743 | 3/1995 | Brick et al. | 430/496 |
| 5,397,826 | 3/1995 | Wexler | 524/356 |
| 5,413,900 | 5/1995 | Yokota | 430/501 |
| 5,460,923 | 10/1995 | Goto et al. | 430/455 |
| 5,529,890 | 6/1996 | McGuckin et al. | 430/372 |
| 5,578,432 | 11/1996 | McGuckin et al. | 430/463 |

FOREIGN PATENT DOCUMENTS

| | | | |
|---|---|---|---|
| 0 395 442 A3 | 10/1990 | European Pat. Off. | G03C 7/30 |
| 6-289559 | 10/1994 | Japan | G03C 11/00 |

OTHER PUBLICATIONS

3M Fluorad Fluorosurfactants Selection Guide Issued Oct. 1996—Performance Chemicals & Fluids, 3M Specialty Chemicals Division.

3M Fluorad Fluorosurfactants for Coating Formulations and Household Product Additives, issued Oct. 1996.

Dupont Special Chemicals, Zonyl Fluorosurfactants "Technical Information", issued Aug. 1993.

Hoechst Celanese, Product Data on Fluowet OTN, issued Mar. 1996.

Dupont Specialty Chemicals, Zonyl FS-300 Fluorosurfactant, "Technical Information", issued Sep. 1994.

*Primary Examiner*—Hoa Van Le

*Attorney, Agent, or Firm*—J. Lanny Tucker

[57] ABSTRACT

Photographic films having a magnetic recording layer are processed using a final processing solution containing a mixture of surfactants. The final processing solution can be a final rinse solution or an image stabilizing solution further containing an image stabilizer. The specific final processing solution composition provides processed films that are free of scum, non-tacky, and resistant to abrasion and fingerprinting on the back side.

17 Claims, No Drawings

PROCESSING MAGNETIC-BACKED SILVER HALIDE FILMS WITH A FINAL PROCESSING SOLUTION

FIELD OF THE INVENTION

This invention relates in general to photography, and more particularly, it relates to the processing of silver halide films that have a magnetic backing layer using a specific final processing solution.

BACKGROUND OF THE INVENTION

During the processing of photographic materials, one or more rinsing or washing steps may be used to remove residual processing solution from the materials prior to contact with the next processing solution. Moreover, before processed materials are dried, they are generally washed a last time to remove all remaining chemical residues so that when they are dried, they are free of lines, water spots or scum. For example, in processing most films and papers (both color and black and white), a final rinsing or stabilizing step is used prior to drying.

Many different formulations have been proposed for use as final rinse solutions in photographic processes immediately prior to drying. Generally, they include one or more surfactants that facilitate the "cleaning" of the photographic material and uniform liquid drainage. Some final processing solutions also contain dye image stabilizers and are thusly known as stabilizing solutions. In addition, rinse or stabilizing solutions can contain one or more biocides to prevent unwanted biological growth in the processing tank or on the photographic material. The solutions may additionally contain calcium ion sequestering agents or polymers such as polyvinylpyrrolidone to reduce precipitation of sulfur or sulfides.

To meet all of the needs of a final processing solution, a careful formulation of components, generally surfactants and biocides, must be made. Proper balancing is required to keep costs low, minimize foaming and biological growth, while achieving the desired drainage and defect free processing expected by highly critical customers.

For final processing solutions that are dye image stabilizing solutions, the presence of a dye image stabilizer further complicates the formulation needs. Dye image stabilizers typically have a methylene group (or is capable of producing a methylene group) that prevents redox degradation of certain magenta dye forming couplers. Thus, dye stain can be reduced or dye image enhanced with such solutions. Typical stabilizers include aldehydes, such as formaldehyde. Hexamethylenetetramine (HMTA) is a known substitute for formaldehyde because of its lower volatility. The addition of the stabilizer, and the type of stabilizer, can render some conventional surfactants in final rinse solutions ineffective in washing scum and other residue from the processed films.

Not every final processing solution (either final rinse or stabilizing solution) useful for processing one type of photographic element may be useful for processing other types of elements. Each type of photographic element may have surface characteristics, or be processed using unique chemicals that require unique final processing solution components.

For example, a stabilizing solution useful to process many conventional color negative films in the conventional KODAK FLEXICOLOR C-41RA™ Process contains hexamethylenetetramine and a mixture of a nonionic surfactant and an anionic surfactant. This processing solution is described, for example, in recently allowed U.S. Ser. No. 08/336,431 (filed Nov. 9, 1994 by McGuckin et al).

However, it has been observed that such stabilizing solutions are not useful when processing photographic films having a magnetic recording layer on one side of the polymeric film support. Such films are well known, being described for example, in U.S. Pat. No. 5,395,743 (Brick et al) and U.S. Pat. No. 5,397,826 (Wexler). Films having magnetic recording layers are transported in cameras and across magnetic heads frequently so they must be durable and have sufficient abrasion and scratch resistance. Generally a lubricant such as a fatty acid ester, such as carnauba wax, is applied to the magnetic layer to facilitate film transport and durability. Apparently, the presence of such magnetic recording layers and/or the lubricants diminish the rinsing ability of the conventional final processing solutions. The result is that they can remain tacky after processing with the known stabilizing solutions, are easily abraded and are susceptible to finger printing. These base-side defects are highly undesirable because they can cause defects on the eventual color prints provided from the processed color negatives. They can also cause contamination of or interference with magnetic heads, resulting in a loss of information.

Thus, there is a continued need in the art for an improved, low cost, effective and non-scumming photographic final processing solution that achieves all of the desired results when magnetic-backed films are processed.

SUMMARY OF THE INVENTION

The present invention provides an advance in the art of processing photographic films by providing a method for photographic processing comprising:

treating an imagewise exposed and developed silver halide photographic film comprising a polymeric support and having disposed on one side thereof, a silver halide emulsion layer, and disposed on the other side thereof, a magnetic recording layer, with a final processing solution comprising:

a first surfactant that is a nonionic polyethoxylated non-fluorinated surfactant, and a second surfactant that is either a nonionic fluorinated surfactant, or an anionic sulfate or sulfonate surfactant.

The processing method of this invention represents an improvement in the art because the specific final processing solution acceptably rinses the photographic films with the magnetic recording layers while the conventional final processing solutions do not. This improvement is achieved with a specific combination of a first and second surfactant, one being a nonionic polyethoxylated non-fluorinated surfactant, and the second one being either a nonionic fluorinated surfactant, or an anionic sulfate or sulfonate surfactant.

The resulting magnetic backed films processed using this invention show reduced residue (scum) and are non-tacky, and resistant to abrasion and fingerprinting. Moreover, the stabilizing solutions used in the method can be formulated, packaged and stored in a single concentrated composition. They are not susceptible to degradation under low pH conditions.

DETAILED DESCRIPTION OF THE INVENTION

The final processing solutions of this invention are aqueous solutions generally having a pH of from about 4 to about 10. Preferably, the pH is from about 5 to about 9, and more preferably, it is from about 6.5 to about 8.5.

The final processing solution can be packaged and transported as a working strength solution, or as a single concentrated composition. It can be used as a replenisher as well as the initial tank working solution.

The first essential surfactant in the final processing solution is a water-soluble nonionic polyethoxylated non-fluorinated surfactant, or a mixture of such materials. Nonionic surfactants refer to surfactants that are not ionized in an aqueous medium.

Particularly useful nonionic polyethoxylated non-fluorinated surfactants include, but are not limited to, polyhydric alcohols and hydrocarbon polyethoxylated surfactants having the general formula (I):

$$R\text{-}(b)_x\text{-}(e)_m\text{-}D$$

wherein R is a substituted or unsubstituted alkyl group having 8 to 20 carbon atoms, B is a substituted or unsubstituted phenyl group, x is 0 or 1, E is —$(OCH_2CH_2)$—, m is an integer of 6 to 20, and D is hydroxy or methoxy.

Examples of useful nonionic non-fluorinated surfactants include, but are not limited to,

- octylphenoxypoly(ethyleneoxide)(9) ethanol (available from Union Carbide Co. under the tradename TRITON X-100),
- octylphenoxypolyethyleneoxide(12) ethanol (available from Union Carbide Co. under the tradename TRITON X-102),
- octylphenoxypolyethyleneoxide(30–40) ethanol (available from Union Carbide Co. under the tradename TRITON X-405),
- alkyl($C_{12-15}$ mixture) polyethyleneoxide(7) alcohol (available from Shell Chemical Co. under the tradename NEODOL 25-7),
- tridecylpolyethyleneoxide(12) alcohol (available from ICI Americas, Inc., under the tradename RENEX 30),
- poly(ethylene oxide)-poly(propylene oxide), and poly (ethylene oxide) di-ol (available from BASF Corp., under the tradename PLURONIC L-44), and
- nonylphenoxy poly [hydroxy propylene oxide (8-10)] (available from Olin Corp. under the tradename SURFACTANT 10G).

Preferred nonionic surfactants of this type include the TRITON brand surfactants and NEODOL 25-7 surfactant.

Other useful materials of this type are well known in the patent and trade literature, and would therefore be readily apparent to one skilled in the art.

The second surfactant in the final processing solution used in this invention is selected from two sub-classes, or can be a mixture from any or several of these sub-classes. Thus, the second surfactant can be a nonionic fluorinated surfactant, or an anionic sulfate or sulfonate surfactant, or a mixture from any or several of these types of materials. Anionic surfactants refer to surfactants having a net negative charge in an aqueous medium.

Nonionic fluorinated surfactants are also known in the art. Typically, such compounds are water-soluble and have one or more fluorocarbon moieties in the molecule wherein at least one hydrogen atom has been replaced with a fluorine atom. Each fluorocarbon moiety generally has at least 4 carbon atoms and can be saturated or unsaturated.

A representative class of nonionic fluorinated surfactants has the formula (II):

$$R_f\text{—}CH_2CH_2O(CH_2CH_2O)_z\text{—}H$$

wherein $R_f$ is $$F(CF_2CF_2)_{3\text{-}8}$$

and z is 4 to 20.

Representative surfactants of this type include, but are not limited to,

- fluoroalkylpolyethyleneoxide alcohols, such as those commercially available as ZONYL FSN, ZONYL FS 300 or ZONYL FSO from DuPont Co., or as FLURAD FC-430or FLUOWET TO from American Hoechst. ZONYL FSO nonionic surfactant is most preferred of this type of material.

Useful subclasses of anionic surfactants include, but are not limited to, sulfates or sulfonates.

In one embodiment, preferred sulfate or sulfonate surfactants have the general formula (III):

$$R_1\text{-}(a)\text{-}C$$

wherein $R_1$ is a substituted or unsubstituted alkyl having 8 to 20 carbon atoms (preferably 10–16 carbon atoms), A is a substituted or unsubstituted arylene, or a substituted or unsubstituted hydroxyethylene group, and C is—$SO_3^-M^{30}$ or —$SO_4^{-M30}$ wherein $M^+$ is hydrogen, or an alkali metal or ammonium cation.

More preferably, A is a substituted or unsubstituted arylene group (such as phenylene, xylylene or naphthylene) with phenylene being most preferred. Thus, an alkylbenzenesulfonate is a preferred subclass of the compounds of formula (III).

Representative surfactants of this formula include:

- sodium dodecylbenzenesulfonate (available from Rhone-Poulenc under the tradename SIPONATE DS-10),
- sodium 2-hydroxy-tetra, hexadecane-1-sulfonate (available from Witco under the tradename WITCONATE AOS), and
- sodium nonylphenoxypolyethoxy sulfate (available from Witco under the tradename WITCOLATE D51-51).

In another embodiment, the anionic sulfate or sulfonate surfactant can have the general formula (IV):

$$(R_2)_n\text{-}(B)_x\text{-}(E)_y\text{-}C$$

wherein $R_2$ is a substituted or unsubstituted alkyl having 4 to 20 carbon atoms (more preferably 4 to 16 carbon atoms), x is 0 or 1, n is 1 when x is 0, and n is 1, 2 or 3 when x is 1, y is an integer of 1 to 8,and B, C and E are defined above.

Useful compounds of this type include alkylphenoxypolyethoxysulfates and alkylpolyethoxysulfates. More specifically, it is preferred that the compound be aromatic when x is 1. Representative compounds include:

- sodium tributylphenoxypolyethoxysulfate (available from Hoechst Celanese under the tradename HOSTAPAL BV),
- sodium alkyl($C_{9-12}$)polyethyleneoxide(7)-ethanesulfonate (available from PPG under the tradename AVANEL S-70), and
- sodium alkyl($C_{12-15}$) polyethoxy(3)sulfate (available from Witco under the tradename WITCOLATE ES-3).

Various anionic surfactants are also described in U.S. Pat. No. 5,360,700 (Kawamura et al) and recently allowed U.S.

Ser. No. 08/336,431 (filed Nov. 9, 1994, by McGuckin et al), all incorporated herein by reference with respect to the anionic surfactants.

Other examples of both nonionic and anionic surfactants that are available commercially are described by tradename and commercial source in *McCutcheon's Volume* 1: Emulsifiers & Detergents, 1993 North American Edition, McCutcheon Division, MC Publishing Co., Glen Rock, N.J.

The amount of one or more first surfactants in the final processing solution is at least about 0.03 g/l, preferably from about 0.03 to about 5 g/l, and more preferably from about 0.05 to about 0.5 g/l. The amount of one or more second surfactants is generally present in an amount of at least about 0.005 g/l, preferably from about 0.005 to about 4 g/l, and more preferably from about 0.01 to about 2 g/l. The weight ratio of the two types of surfactants can vary widely, but preferably, the weight ratio is from about 1000:1 to about 1:1000 (first surfactant to second surfactant). More preferably, the weight ratio is from about 20:1 to about 1:20, with a about 1:1 weight ratio being most preferred for most combinations. The ZONYL brand nonionic fluorinated surfactants generally can be used at lower concentrations.

While not necessary, other addenda can be included in the final processing solution if desired, including but not limited to, conventional biocides (such as isothiazolones, halogenated phenolic compounds disulfide compounds and sulfamine agents), water-soluble polymers (such as polyvinyl pyrrolidones), water-soluble metal chelating agents (such as hydrolyzed polymaleic anhydride polymers, inorganic and organic phosphoric acids and aminopolycarboxylic acids), defoaming agents, a source of cupric ion (such as cupric nitrate), buffers and other materials readily apparent to one skilled in the photographic art.

Where the final processing solution is a stabilizing solution, it contains one or more dye image stabilizers such as various aldehydes (such as formalin), aldehyde precursors (such as sodium formaldehyde bisulfite), hexamethylenetetramine, N-methylol compounds, and other stabilizing compounds known in the art. Such compounds are described, for example, in U.S. Pat. No. 4,786,583 (Schwartz), U.S. Pat. No. 4,859,574 (Gormel) and U.S. Pat. No. 5,360,700 (noted above), EP-A-0 395 442 (published Oct. 31, 1990) and Japanese Kokai 6-289559 (published Oct. 18. 1994). Non-formaldehyde-containing or -producing stabilizing compounds are preferred. Hexamethylenetetramine is most preferred. Mixtures of stabilizing compounds can be used if desired.

The amount of stabilizing compound in the final processing solution is generally at least about 1 g/l, and amounts of from about 3 to about 6 g/l are preferred. Amounts of from about 3.5 to about 4.5 g/l are most preferred.

The components of the final processing solution described herein can be mixed together in any suitable order as would be known in the art, and stored indefinitely or used immediately. The solution can also be concentrated for storage and transportation, then diluted with water or a suitable buffer prior to use. It can be used as the working solution or as a replenisher using any suitable replenishment rate.

The final processing solution is used in the final processing step, after fixing or washing, and prior to drying. Preferably, one or more water washing steps precede the final processing step.

The present invention can therefore be used to process color, or black and white, negative (Process C-41) films having a magnetic backing layer or stripe.

The emulsions and other components, and element structure of such photographic materials and the various steps used to process them are well known and described in considerable publications, including, for example, in *Research Disclosure*, publication 36544, pages 501–541 (Sep., 1994) and hundreds of references noted therein. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "Research Disclosure". More details about such elements are provided herein below. The invention can be practiced with photographic films containing any of many varied types of silver halide crystal morphology, sensitizers, color couplers, and addenda known in the art, as described in the noted *Research Disclosure* publication and the many publications noted therein. The films can have one or more layers, at least one of which is a silver halide emulsion layer that is sensitive to electromagnetic radiation, disposed on a suitable film support (typically a polymeric material).

The processing film elements typically have a magnetic recording layer, or stripe, on the support opposite the silver halide emulsion layer(s).

Formulations for preparing magnetic recording layers are also well known in the art, as described for example, in *Research Disclosure*, publication 34390, November, 1992, U.S. Pat. No. 5,395,743 (Brick et al), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. Preferably, the binder is transparent so the layer is transparent, but this is not essential. As might be expected, it is highly desirable that the magnetic recording layer not only exhibit desired magnetic and photographic performance, but that it also be highly durable, abrasion resistant and scratch resistant.

Suitable ferromagnetic particles would be readily apparent to one skilled in the art. They include, but are not limited to, ferromagnetic iron oxides (such as $\gamma$-$Fe_2O_3$ or $Fe_3O_4$) with or without cobalt, zinc or other metal dopants in solid solution or surface treated, ferromagnetic chromium dioxides with or without metallic elements or halogen atoms in solid solution, ferromagnetic chromium dioxide powders, barium ferrite and others known in the art. Ferromagnetic metal pigments with an oxide coating on their surface to improve their chemical stability or to improve dispersibility as is commonly employed in conventional magnetic recording, may also be used if desired. In addition, magnetic oxides with a thicker layer of lower refractive index oxide or other material having a lower optical scattering cross-section can be used. Cobalt doped-iron oxide is the preferred ferromagnetic material useful in the practice of this invention.

The magnetic recording layer typically contains one or more transparent binders, dispersant-cobinders, optional non-magnetic particulate materials, grind solvents, coating aids, surfactants, crosslinking agents, catalysts, and other conventional addenda for such layers. The amounts and proportions of the various components of such layers are also known in the art (see publications noted above).

While the magnetic recording layer can cover only a portion of the surface of the support, generally it covers nearly the entire surface, and can be applied using conventional procedures including coating, printing, bonding or laminating.

Various supports can be used for the films processing according to this invention including the conventional acetates, cellulose esters, polyamides, polyesters, polystyrenes and others known in the art. Polyesters such as poly(ethylene terephthalate) and poly(ethylene naphthalate) are preferred. These materials can be subbed or unsubbed and coated with various antihalation, antistatic or other non-imaging layers as is known in the art. Particularly useful antistatic layers on the backside of the elements include vanadium pentoxide in a suitable binder.

Because the elements having a magnetic recording layer are transported in cameras and across magnetic heads, they generally have a lubricant, such as a fatty acid ester (for example, butyl stearate), applied to the magnetic recording layer to facilitate element transport. The lubricant can be in the form of a uniform coating, or present in a regular or irregular pattern. The lubricant can be a single material or a mixture of two or more materials as long as the eventual coating provides a coefficient of friction of less than about 0.5. Coefficient of friction is determined using a conventional paper clip friction test described, for example, in ANSI IT 9.4-1992. Various lubricants can be used such as silicone oils or waxes, fluorine-containing alcohols, esters or ethers, fluorinated polyalkanes, polyolefins, polyglycol alkyl phosphates or alkali metal salts thereof, polyphenyl ethers, fluorine-containing alkylsulfates or alkali metal salts thereof, monobasic fatty acids or metal salts thereof, mono- or polyvalent alcohols, alkoxy alcohols, fatty acid esters or monoalkyl ethers or alkylene oxide polymers, fatty acid amides and aliphatic amines. A preferred lubricant is commercially available carnauba wax.

Reagents and solutions for black and white and color development are well known, and described, for example, in *Research Disclosure* (noted above), sections XVIII and XIX, and the many references described therein. Thus, besides a developing agent (either black and white or color developing agent), the developers can include one or more buffers, antioxidants (or preservatives), antifoggants, solubilizing agents, brighteners, halides, sequestering agents and other conventional addenda.

Bleaching and fixing solutions and reagents are also well known, as described for example, in *Research Disclosure* (noted above), section XX and the many references noted therein. Common bleaching agents include, but are not limited to, ferric salts or ferric binary or ternary complexes of aminopolycarboxylic acids of many various structures. Fixing agents include, but are not limited to, thiosulfates. Various bleaching and fixing accelerators are also known.

Processing steps and solutions specific to processing color negative films (Process C-41) are known in the art.

Processing according to the present invention can be carried out using conventional deep tanks holding processing solutions. Alternatively, it can be carried out using what is known in the art as "low volume thin tank" processing systems using either rack and tank, roller transport or automatic tray designs. Such processing methods and equipment are described, for example, in U.S. Pat. No. 5,436,118 (Carli et al) and publications cited therein.

The following examples are included for illustrative purposes only. Unless otherwise indicated, the percentages are by weight.

Materials and Methods for Examples:

In the following Examples 1, 2 and 3 (cine processing only), the film samples were processed using the following conditions:

| | | |
|---|---|---|
| Color development | 195 sec. | 37–38° C. |
| Bleaching | 390 sec. | 35–41° C. |
| Washing | 195 sec. | 24–41° C. |
| 1st fixing | 195 sec. | 35–41° C. |
| 2nd fixing | 195 sec. | 35–41° C. |
| Washing | 195 sec. | 24–41° C. |
| Stabilizing | 98–195 sec. | 24–41° C. |
| Drying | | |

For minilab processing in Example 3, the processing conditions were as follows:

| | | |
|---|---|---|
| Color development | 195 sec. | 37–38° C. |
| Bleaching | 45 sec. | 35–41° C. |
| 1st fixing | 45 sec. | 35–41° C. |
| 2nd fixing | 45 sec. | 35–41° C. |
| 1st Stabilizing | 20 sec. | 35–41° C. |
| 2nd Stabilizing | 20 sec. | 35–41° C. |
| 3rd Stabilizing | 20 sec. | 35–41° C. |
| Drying | | |

For Examples 1, 2 and 3 (cine processing), color development, bleaching, washing and fixing was carried out using conventional Kodak Process C-41 processing solutions. For the minilab processing of Example 3, color development, bleaching, washing and fixing were carried out using conventional Kodak Process C-41RA processing solutions. The various stabilizing solutions used in the examples are identified below.

Color negative photographic films having no magnetic backing layer used in the following examples were samples of commercially available KODAK GOLD PLUS 100 Film (identified below as "Film A") and KODAK VERICOLOR III Professional Film (identified below as "Film B"). The magnetic backed color negative photographic films used in the examples were samples of ISO 100 speed color negative film (identified below as "Film C") having a magnetic backing layer, the components of which are described above in considerable detail in the Wexler and Brick et al patents, and *Research Disclosure*, publication 34390, all noted above. Film C comprised a lubricant (carnauba wax) on the magnetic recording layer.

The processed film samples were examined for residue after stabilizing by viewing the base side under a halogen specular light source (Sunnex Model 703-27 with 20 watt halogen lamp and frosted lens) positioned about six inches (about 15 cm) from the film sample. The amount of observed residue was rated on a scale of 1 to 4o A rating of "1"meant no residue, a rating of "2" meant easily noticed residue under specular light, a rating of "3" meant easily noticed residue under normal room light, and a rating of "4"meant a very noticeable, heavy residue deposit under normal room lighting. Film samples that did not fit exactly into the ratings were given ½ ratings between the two most appropriate numbers.

Other evaluations of the processed film samples included visual observations of base side surface tackiness, abradability and susceptibility to fingerprinting.

EXAMPLE 1

Processing Using Rack and Tank Processor

Color negative film samples were processed using a conventional PAKO Model HTC rack and tank processing machine. The following stabilizing solutions were used in the various processing experiments:

| | |
|---|---|
| Control: | Conventional KODAK FLEXICOLOR Stabilizer and Replenisher containing SILWET L-7607 polysiloxane surfactant (1.2 ml/l), formalin (37%, 4 ml/l) and water to 1 liter. |
| Solution A: | WITCOLATE ES-3 anionic surfactant (0.2 g/l), TRITON X-102 nonionic surfactant (0.2 g/l), formalin (37%, 4.0 ml/l) and water to 1 liter. |
| Solution B: | WITCOLATE D51-51 anionic surfactant (0.2 g/l), TRITON X-102 nonionic surfactant (0.2 g/l), formalin (37%, 4 ml/l) and water to 1 liter. |
| Solution C: | ZONYL FSO nonionic fluorinated surfactant (0.025 g/l), NEODOL 25-7 nonionic surfactant (0.2 g/l), formalin (37%, 4 ml/l) and water to 1 liter. |

The evaluations of the processed Films A, B and C using the Control, A and B solutions are shown in TABLE I below. The evaluations of the same processed films using Solution C are shown in TABLE II below.

The results shown in TABLES I and II indicate that the samples of Film C processed using the Control stabilizing solution were considerably tacky on the base side of the film, and were easily abraded and fingerprinted. The residue was considerable on these film samples also.

Solutions A, B and C provided varying degrees of less residue, but clearly reduced the surface tackiness, abradability and susceptibility to finger-printing.

TABLE I

| Stabilizer | Residue Evaluation | | | Tackiness | Easily Finger-printed? | Easily Abraded? |
|---|---|---|---|---|---|---|
| Solution | Film A | Film B | Film C | | | |
| Control | 1 | 1 | 3 | Yes | Yes | Yes |
| Control | 1 | 1 | 2.5 | Yes | Yes | Yes |
| Control | 1 | 1 | 2.5 | Yes | Yes | Yes |
| Solution A | 2 | 1 | 2 | No | No | No |
| Solution A | 1.5 | 1 | 2 | No | No | No |
| Solution A | 2 | 1 | 2.5 | No | No | No |
| Solution B | 1 | 1 | 2 | No | No | No |
| Solution B | 1 | 1 | 1 | No | No | No |
| Solution B | 1 | 1 | 1.5 | No | No | No |

TABLE II

| Stabilizer Solution | Number of Samples | Residue Evaluation* | Tackiness | Easily Finger-printed? | Easily Abraded? |
|---|---|---|---|---|---|
| Control | 51 | 2.2 | Yes | Yes | Yes |
| Solution A | 11 | 1.7 | No | No | No |
| Solution B | 54 | 1.8 | No | No | No |
| Solution C | 28 | 1.1 | No | No | No |

*Average for all tested samples

EXAMPLE 2

Processing Using Different Processor

The experiments described in Example 1 to process Film C were repeated using a conventional REFREMA Compact Model 90 GL/V-ESS rack and tank processor. The residue, tackiness, abradability and susceptibility to fingerprinting results are shown in TABLE III.

TABLE III

| Stabilizer Solution | Number of Samples | Residue Evaluation* | Tackiness | Easily Finger-printed? | Easily Abraded? |
|---|---|---|---|---|---|
| Control | 6 | 1.9 | Yes | Yes | Yes |
| Solution B | 6 | 2.5 | No | No | No |
| Solution C | 6 | 1.1 | No | No | No |

*Average for all tested samples

EXAMPLE 3

Processing Using HMTA Stabilizer

Samples of Film C were processed in minilab and cine processors using the processing protocol and KODAK Process C-41RA solutions described above, and using the following stabilizing solutions:

| | |
|---|---|
| Solution D | Hexamethylenetetramine (4 g/l), diethanolamine (0.85 g/l), TRITON X-102 nonionic surfactant (0.2 g/l), WITCOLATE ES-3 anionic surfactant (0.2 g/l), IRGAFORM 3000 anti-calcium agent (0.05 g/l), PROXEL GXL (60 ppm), polyvinylpyrrolidone (0.25 g/l) and water to 1 liter. |
| Solution E | Same as Solution D without the polyvinylpyrrolidone. |

Over 14,000 feet (4267 meters) of Film C were processed in a conventional Noritsu QSF 450A-3U minilab processor using Solution D as the stabilizing solution. No observable residue was found on the processed film.

Similarly, over 1200 feet (366 meters) of Film C were processed in a PAKO cine processor using Solution E. No observable residue was found on the processed film.

EXAMPLE 4

Processing with Final Rinse Solution Samples of Film C were processed using the solutions shown below as final rinse solutions after processing using the conventional KODAK Process C-41RA solutions and conditions described above.

| | |
|---|---|
| Solution F | WITCOLATE D51-51 anionic surfactant (0.2 g/l), TRITON X-102 nonionic surfactant (0.2 g/l), Kathon LX (10 ppm), cupric nitrate (1 ppm) and water to 1 liter. |
| Solution G | ZONYL FSO nonionic fluorinated surfactant (0.025 g/l), NEODOL 25-7 nonionic surfactant (0.2 g/l), Kathon LX (10 ppm), cupric nitrate (1 ppm) and water to 1 liter. |
| Solution H | Like Solution G except SIPONATE DS-10 anionic surfactant (0.2 g/l) was used in place of NEODOL 25-7 nonionic surfactant. |

Processing was carried out as described in Example 1 except the final rinse solutions F, G or H were used in place of the stabilizing solutions. The results from processing are shown in TABLE IV below. Little residue was observed, and the film samples were non-tacky, and resistant to abrasion and finger printing.

TABLE IV

| Rinse Solution | Number of Samples | Residue Evaluation* | Tackiness | Easily Finger-printed? | Easily Abraded? |
|---|---|---|---|---|---|
| Solution F | 43 | 2.3 | No | No | No |
| Solution G | 37 | 1.9 | No | No | No |
| Solution H | 6 | 1.8 | No | No | No |

*Average for all tested samples

The invention has been described in detail with particular reference to preferred embodiments thereof, but it will be understood that variations and modifications can be effected within the spirit and scope of the invention.

We claim:

1. A method for photographic processing comprising:

treating an imagewise exposed and developed silver halide photographic film comprising a polymeric support and having disposed on one side thereof, a silver halide emulsion layer, and disposed on the other side thereof, a magnetic recording layer, with a final processing solution comprising:

a first surfactant that is a nonionic polyethoxylated non-fluorinated surfactant that is present in an amount of at least about 0.03 g/l, and a second surfactant that is a nonionic fluorinated surfactant that is present in an amount of at least about 0.005 g/l.

2. The method of claim 1 wherein said final processing solution is a stabilizing solution that further comprises a dye image stabilizer.

3. The method of claim 2 wherein said dye image stabilizer is formaldehyde, a formaldehyde precursor or hexaraethylenetetramine.

4. The method of claim 3 wherein said dye image stabilizer is hexamethylenetetramine.

5. The method of claim 1 wherein said nonionic polyethoxylated non-fluorinated surfactant has the General formula (I):

$$R\text{-}(B)_x\text{-}(E)_m\text{-}D$$

wherein R is alkyl having 8 to 20 carbon atoms, B is phenyl, x if 0 or 1, E is $-(OCH_2CH_2)-$, m is an integer of 6 to 20, and D is hydroxy or methoxy.

6. The method of claim 5 wherein said polyethoxylated non-fluorinated surfactant is octylphenoxypoly (ethyleneoxide) (9) ethanol, octylphenoxypoly (ethyleneoxide)(12) ethanol, octylphenoxypoly (ethyleneoxide) (30-40) ethanol, alkyl($C_{12-15}$ mixture) poly (ethyleneoxide) (7) alcohol, tridecylpolyethyleneoxide(12), poly(ethylene oxide)-poly(propylene oxide), poly(ethylene oxide) di-ol, or nonylphenoxy poly.

7. The method of claim 1 wherein said nonionic fluorinated surfactant has the formula (II):

$$R_f-CH_2CH_2O(CH_2CH_2O)_z-H$$

wherein $$F(CF_2CF_2)_{3-8}$$

and z is 4 to 20.

8. The method of claim 1 wherein the weight ratio of said first surfactant to said second surfactant is from about 1:1000 to about 1000:1.

9. The method of claim 8 wherein the weight ratio of said first surfactant to said second surfactant is from about 1:20 to about 20:1.

10. The method of claim 2, wherein said dye image stabilizer is present in said final processing solution in an amount of at least about 1 g/l.

11. The method of claim 1 wherein said magnetic recording layer is transparent and comprises a dispersion of ferromagnetic particles in a transparent polymeric binder.

12. The method of claim 11 wherein said ferromagnetic particles comprise ferric oxides doped with cobalt or zinc.

13. The method of claim 1 wherein said polymeric support is composed of a polyester selected from the group consisting of polyethylene terephthalate, polyethylene naphthalate, poly-1,4-cyclohexanedimethylene terephthalate, polyethylene 1,2-diphenoxyethane-4,4'- dicarboxylate and polybutylene terephthalate.

14. The method of claim 1 wherein said photographic film comprises a lubricant on said magnetic recording layer.

15. The method of claim 14 wherein said lubricant is carnauba wax.

16. The method of claim 14 wherein said lubricant is carnauba wax, and said photographic film has a polyester support composed of polyethylene naphthalate.

17. A method for photographic processing comprising:

treating an imagewise exposed and developed silver halide photographic film comprising a polymeric support and having disposed on one side thereof, a silver halide emulsion layer, and disposed on the other side thereof, a magnetic recording layer, with a final processing solution comprising:

a first surfactant that is a nonionic polyethoxylated non-fluorinated surfactant that is present in an amount of at least about 0.03 g/l, and a second surfactant that is a nonionic fluorinated surfactant that is present in an amount of at least about 0.005 g/l.

* * * * *